US010646911B2

(12) United States Patent
Alpen et al.

(10) Patent No.: US 10,646,911 B2
(45) Date of Patent: May 12, 2020

(54) METHOD AND PRESSING TOOL FOR PRODUCING A COMPLEX FORMED SHEET METAL PART WITH GREAT DRAWING DEPTH

(71) Applicant: AUDI AG, Ingolstadt (DE)

(72) Inventors: Timo Alpen, Untereisesheim (DE); Holger Dierolf, Zuettlingen (DE); Jörg Spindler, Hardthausen (DE); Torsten Schilling, Schwaigern (DE); Bernhard Oberpriller, Kornwestheim (DE)

(73) Assignee: Audi AG, Ingolstadt (DE)

( * ) Notice: Subject to any disclaimer, the term of this patent is extended or adjusted under 35 U.S.C. 154(b) by 391 days.

(21) Appl. No.: 15/593,758

(22) Filed: May 12, 2017

(65) Prior Publication Data

US 2017/0326612 A1 Nov. 16, 2017

(30) Foreign Application Priority Data

May 13, 2016 (DE) ..... 10 2016 005 902

(51) Int. Cl.
*B21D 24/04* (2006.01)
*B21D 22/06* (2006.01)
(Continued)

(52) U.S. Cl.
CPC ..... *B21D 22/06* (2013.01); *B21D 22/22* (2013.01); *B21D 22/26* (2013.01); *B21D 24/04* (2013.01); *B21D 24/10* (2013.01)

(58) Field of Classification Search
CPC ..... B21D 37/08; B21D 22/06; B21D 22/10; B21D 22/20; B21D 22/206; B21D 22/22;
(Continued)

(56) References Cited

U.S. PATENT DOCUMENTS 5,600,991 A 2/1997 Munzen
5,941,110 A * 8/1999 Cao ..... B21D 22/02 72/20.1
(Continued)

FOREIGN PATENT DOCUMENTS

CN 101164715 A 4/2008
CN 101195142 A 6/2008
(Continued)

OTHER PUBLICATIONS

European Search Report dated Oct. 9, 2017 with respect to counterpart European patent application EP 17 00 0777.
(Continued)

*Primary Examiner* — Shelley M Self
*Assistant Examiner* — Katie L. Parr
(74) *Attorney, Agent, or Firm* — Henry M. Feiereisen LLC

(57) ABSTRACT

A method for producing a complex sheet metal part includes clamping a border region of the metal sheet between a die ring of an upper tool part of a pressing tool and a downholder of a lower tool part of the pressing tool; moving the upper tool part further downwards thereby pulling the metal sheet over extended punch inserts of a punch of the lower tool part, thereby generating local material reserves of the metal sheet; moving the upper tool part further downwards while actively retracting the punch inserts, thereby releasing the local material reserves; and forming the metal sheet between the die and the punch using only the local material reserves.

10 Claims, 1 Drawing Sheet

(51) Int. Cl.
*B21D 22/22* (2006.01)
*B21D 22/26* (2006.01)
*B21D 24/10* (2006.01)

(58) Field of Classification Search
CPC ..... B21D 22/24; B21D 22/26; B21D 22/347; B21D 24/005; B21D 24/06; B21D 24/10; B21D 24/12; B21D 25/02; B21D 25/04; B21D 11/02; B21D 13/02; B21D 13/10; B21D 24/04
USPC ..... 72/353.2, 361, 372, 374, 375, 348, 352, 72/385, 465.1, 347
See application file for complete search history.

(56) References Cited

U.S. PATENT DOCUMENTS

| | | | | |
|---|---|---|---|---|
| 7,900,492 | B2 * | 3/2011 | Komatsu | B21D 22/22 72/347 |
| 8,051,696 | B2 * | 11/2011 | Yoshida | B21D 22/22 72/347 |
| 8,250,896 | B2 * | 8/2012 | Hirotani | B21D 22/22 72/313 |
| 8,402,804 | B2 * | 3/2013 | Nakao | B21D 22/06 72/347 |
| 8,429,946 | B2 * | 4/2013 | Maeda | B21D 22/02 72/350 |
| 8,464,591 | B2 * | 6/2013 | Kuwayama | B21D 22/22 73/799 |
| 10,016,804 | B2 * | 7/2018 | Tanaka | B21D 22/26 |
| 2007/0180697 | A1 | 8/2007 | Knaup | |
| 2012/0137749 | A1 | 6/2012 | Park | |

FOREIGN PATENT DOCUMENTS

| | | |
|---|---|---|
| CN | 202224531 U | 5/2012 |
| CN | 105013918 A | 11/2015 |
| DE | 31 49 087 | 8/1982 |
| DE | 198 42 750 | 4/2000 |
| DE | 695 31 233 | 4/2004 |
| DE | 10 2006 005 964 | 7/2007 |
| DE | 10 2010 045 281 | 3/2012 |
| JP | 2007-326112 | 12/2007 |

OTHER PUBLICATIONS

Translation of European Search Report dated Oct. 9, 2017 with respect to counterpart European patent application EP 17 00 0777.
Chinese Search Report dated Jul. 27, 2018 with respect to counterpart Chinese patent application 201710332944.2.
Translation of Chinese Search Report dated Jul. 27, 2018 with respect to counterpart Chinese patent application 201710332944.2.

* cited by examiner

METHOD AND PRESSING TOOL FOR PRODUCING A COMPLEX FORMED SHEET METAL PART WITH GREAT DRAWING DEPTH

CROSS-REFERENCES TO RELATED APPLICATIONS

This application claims the priority of German Patent Application, Serial No. 10 2016 005 902.8, filed May 13, 2016, pursuant to 35 U.S.C. 119(a)-(d), the content of which is incorporated herein by reference in its entirety as if fully set forth herein.

BACKGROUND OF THE INVENTION

The invention relates to a method for producing a complex formed sheet metal part by forming a metal sheet by means of a pressing tool and a pressing tool suited therefore.

The following discussion of related art is provided to assist the reader in understanding the advantages of the invention, and is not to be construed as an admission that this related art is prior art to this invention.

Complex formed sheet metal parts, in particular those for use in vehicle body construction, differ from simple formed sheet metal parts, for example such as a bowl or a trough, in that these sheet metal parts have a more complex shape, which typically includes different surface areas and in particular also further design features, for example design or styling edges and/or stiffening edges with small radii. Because there are limits regarding the feasibility of forming, production of such complex formed sheet metal parts is often difficult and cost-intensive. Special problems are encountered when great drawing depths are to be achieved under serial production conditions.

It would therefore be desirable and advantageous to provide an improved method and an improved tool for producing a complex formed sheet metal part, in particular a large-area formed sheet metal part (for example of >0.5 $m^2$) with which a great drawing depth can be achieved under serial production conditions while ensuring a flawless quality of the parts.

SUMMARY OF THE INVENTION

According to one aspect of the present invention a method for producing a complex sheet metal part said method includes inserting a metal sheet into an open pressing tool, said pressing tool comprising a lower tool part which includes a punch, a downholder surrounding the punch and multiple punch inserts, and an upper tool part which includes a die and a die ring surrounding the die; closing the tool by moving the upper tool part downwards thereby clamping a border region of the metal sheet between the die ring and the downholder; with the punch inserts being in an extended position, moving the upper tool part further downwards so that the die ring displaces the downholder downwards and the metal sheet is pulled over the extended punch inserts, thereby generating local material reserves of the metal sheet; forming a region of the metal sheet between the die ring and the punch by moving the upper tool part further downwards into a position in which the die ring and the downholder have reached respective lower movement dead points, wherein during the moving of the upper tool part into said position the punch inserts are actively retracted, thereby releasing the local material reserves; and forming another region of the metal sheet between the die and the punch by moving the die further downwards until the die reaches a lower movement dead point, wherein during the forming of the other region a peripheral region of the metal sheet is clamped between the die ring and the downholder and between the die ring and the punch so as to prevent flow of metal sheet material from the border region of the metal sheet so that only the local material reserves are used for the forming of the other region.

The process can also be performed with inverse kinematic. In this case the upper tool part and the lower tool part are arranged inversely and are correspondingly configured.

The method according to the invention enables production of a complex sheet metal part with great drawing depth under conditions of serial production in a pressing plant, in particular also with high frame depth, and flawless quality. The term great drawing depth in particular means a drawing depth (=drawing path in working direction) of at least 200 mm, preferably at least 250 mm and in particular at least 300 mm. Within a closing or working movement the formed sheet metal part can essentially be finally formed starting from a plan metal plate, so that at least no additional forming operations that significantly change the drawing depth and/or the shape are required. In a press line the number of required drawing stages can thus be kept low or can even be reduced.

The term active backwards movement of the punch inserts means that the punch inserts are not passively displaced or urged backwards as in the state of the art, but are actively moved back. This can for example be accomplished by a mechanical coupling of the corresponding punch inserts with the downholder so that the punch inserts are moved back by the downholder or are moved or inserted into the punch recesses provided therefore. This can be performed synchronously or asynchronously (i.e., in a defined sequence and/or with different speeds), in order to thereby control the punch contact, i.e., contact between the metal sheet and the punch surface or the effective surface of the punch, in a targeted manner. The tool or the pressing tool can also have punch inserts which are moved or urged back passively in a conventional manner.

According to another advantageous feature of the present invention, at least one of the punch inserts is configured for generating in the metal sheet or formed sheet metal part a design edge with a small radius. The complex sheet metal part that can be generated with the method according to the invention can thus also have at least one distinctive design edge in spite of the significant drawing depth. The outer edge radius of the design edge is preferably only a few millimeters in size. This design edge is free of skid and impact lines because the method according to the invention prevents that the sheet moves relative to the punch during the drawing process.

According to another aspect of the present invention a pressing tool, in particular deep drawing tool, for producing a complex sheet metal part, includes a first tool part including a punch, a displaceable downholder surrounding the punch, and multiple movable punch inserts, wherein the downholder is mechanically coupled with at least one of the punch inserts, so that a displacement of the downholder causes active retraction of the at least one punch insert; and a second tool part including a die and a die ring surrounding the die.

The pressing tool according to the invention can thus be configured so that between the downholder and at least one of the punch inserts, preferably all punch inserts, a mechanical coupling is present by which during the displacement and in particular during the downward movement of the downholder (i.e., during the forming or drawing process as described above) the respective punch insert or the respective punch inserts is/are actively retracted, i.e., moved or inserted into the punch recess/es provided therefore.

According to another advantageous feature of the present invention, the punch inserts can be arranged in the pressing tool so as to enable generating a material reserve (as explained above) in all critical regions at the beginning of the drawing process.

According to another advantageous feature of the present invention, at least one of the punch inserts, in particular the punch insert that is coupled with the downholder, is additionally resiliently supported, for example by means of a gas pressure spring. Preferably all punch inserts are additionally resiliently supported.

According to another advantageous feature of the present invention, at leas one of the punch inserts can be configured for a point contact (=small-area contact) with the metal sheet to be formed. At least one of the punch inserts can be configured for a line contact with the metal sheet to be formed, in particular for forming a design edge with a small radius (as described above).

According to another advantageous feature of the present invention, the die can also have at least one movable die insert which is situated opposite a punch insert, in particular for forming a design edge and which is configured with a corresponding counter contour so that the metal sheet can be formed between the punch insert and the die insert in the manner of an embossment. In analogy to a punch insert such a die insert is arranged in a die recess and is also preferably resiliently supported, for example by means of a gas pressure spring.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1A:
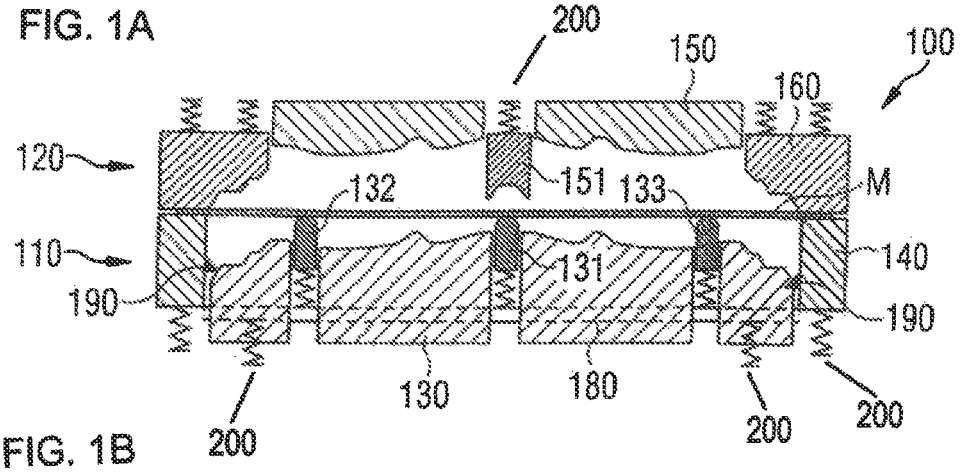
FIGS. 1A-D show respective schematic sectional views of a pressing tool according to the invention, illustrating steps of the method according to the invention.

Throughout all the Figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

FIG. 1A shows a schematic illustration of a pressing tool according to the invention. The pressing tool 100 has a lower tool part 110 and an upper tool part 120. The pressing tool is a deep drawing tool, which is installed in a not shown press, wherein the lower tool part 110 is arranged on the pressing table and the upper tool part 120 is fastened on the press table. During lowering of the press table the upper tool part 120 performs an upward movement or work movement with an essentially continuous downward movement.

The lower tool part 110 has a punch 130 a down holder or sheet holder 140 which surrounds the punch 130, and multiple movable punch inserts 131, 132 and 133. The punch inserts 131, 132 and 133 are arranged in punch recesses. The punch insert 131 is configured for a line contact and the punch inserts 132 and 133 for a point contact. The upper tool part 120 has a die 150 and a die ring or counter holder 160, which surrounds the die 150. The tool 100 is configured for a drawing depth of at least 200 mm. in the following the drawing process is described.

A metal sheet M in the form of a plan metal plate (metal sheet blank) is inserted into the opened tool 100 and the tool 100 is closed by downward movement of the press ram or the upper tool part 120. Hereby a border region of the metal sheet M is clamped between the die ring 160, which precedes the die 150, and the downholder 140, as shown in FIG. 1*a*. The punch inserts 131, 132 and 133 are situated in the extended positions or starting positions in which they protrude over the punch surface or the effective surface.

Figure 1B:
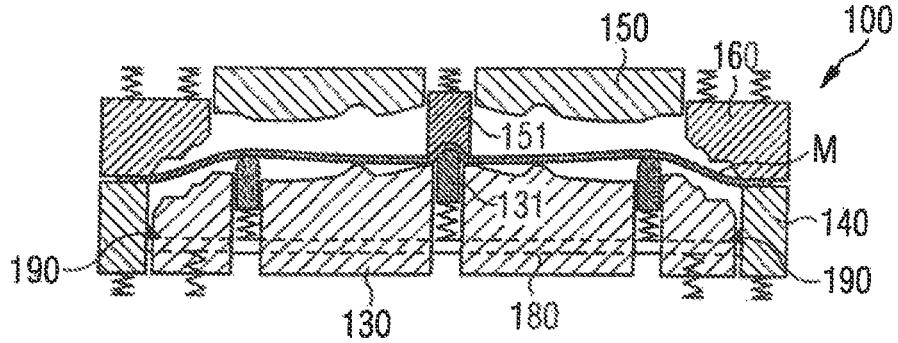

During the further downward movement of the upper tool part 120 the die ring 160 displaces the downholder 140 downwards. This means that the downholder 140 is moved downward together with the die ring 160 and hereby moves relative to the stationary punch 130. The downholder 140 can be supported in a known manner by a drawing pillow which belongs to the press or the tool or the like, as illustrated with the shown springs. Hereby the metal sheet M is pulled over the punch inserts 131, 132 and 133 whereby in the metal sheet M local material reserves are generated. This is shown in FIG. 1B. The punch inserts 131, 132 and 133 are for example resiliently supported by means of gas pressure springs as illustrated with the shown springs 200, so that these push against the metal sheet M with a defined force.

Simultaneously a design edge with small radius is formed into the metal sheet M by means of the center punch insert 131 and the opposite die insert 151, for which purpose the punch insert 131 and the die insert 151 are provided with corresponding forming sections at their respective end sides. Also the die insert 151 is for example resiliently supported with a gas pressure spring as illustrated with the symbolically shown spring 200.

During the further downward movement of the upper tool part 120 the die ring 160 and the downholder 140 are moved to their lower dead point as shown in FIG. 1G. At the same time the punch inserts 131, 132 and 133 are actively retracted, i.e., they are not passively retracted by being displaced, whereupon the metal sheet M can successively contact the punch surface or effective surface of the punch 130 in the region of the punch inserts 131, 132 and 133. In this way a controlled punch contact is achieved. In addition the local material reserves are released for further forming. Also simultaneously the metal sheet M is already formed in an overlap region between the die ring 160 and the punch 130 for which purpose the die ring 160 and the punch 130 are configured with corresponding effective surface areas.

The backward movement or retraction of the punch inserts 131, 132 and 133 is performed by a mechanical forced coupling with the downholder 140. For this purpose the punch inserts 131, 132 and 133 are for example fastened on a frame or a carrier plate 180 which is for example carried along or moved along by means of catches 190 arranged on the downholder 140 when the downholder is moved past a defined downholder position (or past a defined draw path position). The frame 180 is for example resiliently supported on the base plate (not shown) which belongs to the lower tool part 110, as illustrated with the shown springs 200.

Figure 1C:
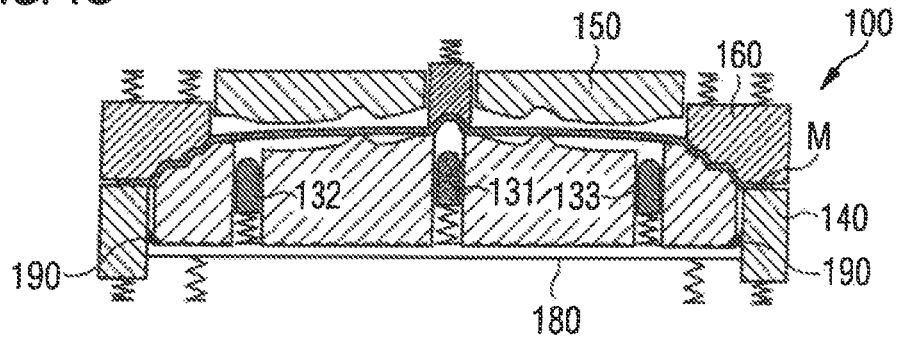

When the downholder 140 has reached its lower dead point (see FIG. 1C) the punch inserts 131, 132 and 133 are also located in their retracted end positions. Depending on the desired goal the end sides of the punch inserts are situated behind the punch surface (as shown in FIG. 1*c*), end flush with the punch surface or still protrude over the punch surface. The retraction and the end positions of the punch inserts can be adjusted individually so that also asynchronous punch insert movements are possible. Different from the shown vertical movement directions of the punch inserts 131, 132 and 133, also oblique movement directions are possible, for example by using sliders.

By further downward movement of the press punch ram or the upper tool part 120 the trailing die 150 is now moved to its lower dead point, wherein the metal sheet M or the formed sheet metal part is finally formed in the middle region (with the forming being already completed in the outer region). This means the die ring 160 first reaches its lower dead point, then the die 150 continues to move until reaching its lower dead point and thereby forms the middle region. Due to the border-side clamping of the metal sheet M between the die ring 160 and the punch 130 no sheet metal material or substantially no sheet metal material can flow from the outside towards the inside, i.e., toward the center region, so that the metal sheet M is formed between the die 150 and the punch 130 in the manner of an embossment by only using the local material reserves that have been generated beforehand by means of the punch inserts 131, 132 and 133, wherein the resiliently supported die insert 151 is retracted or is displaced upwards. As an alternative it can be provided that the middle punch insert 131 is not moved backwards and thus continues to push against the metal sheet M or against the die insert 151.

Figure 1D:
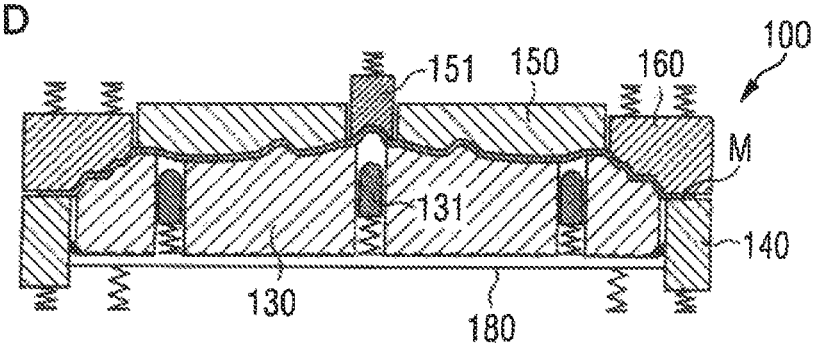

FIG. 1D shows the end state in which the downholder 140, the die ring 160 and the die 150 are in their lower movement dead points. Forming of the metal sheet or sheet meal workpiece M is completed. After opening the tool 100 by lifting or upwards movement of the press ram or the upper tool part 120 the formed sheet metal part can be removed. By means of the springs the tool parts move back into the starting arrangements or positions as shown in FIG. 1A so that the next metal sheet M can be inserted and formed.

What is claimed as new and desired to be protected by Letters Patent is set forth in the appended claims and includes equivalents of the elements recited therein:

What is claimed is:

1. A method for producing a complex sheet metal part said method comprising:

inserting a metal sheet into an open pressing tool, said pressing tool comprising a lower tool part which includes a punch, a downholder surrounding the punch and multiple punch inserts, and an upper tool part which includes a die and a die ring surrounding the die;

closing the pressing tool by moving the upper tool part downwards thereby clamping a border region of the metal sheet between the die ring and the downholder;

with the punch inserts being in an extended position, moving the upper tool part further downwards so that the die ring displaces the downholder downwards and the metal sheet is pulled over the extended punch inserts, thereby generating local material reserves of the metal sheet;

forming a first region of the metal sheet between the die ring and the punch by moving the upper tool part further downwards into a position in which the die ring and the downholder have reached respective lower movement dead points, wherein during the moving of the upper tool part into said position the punch inserts are actively retracted, thereby releasing the local material reserves; and forming a second region of the metal sheet between the die and the punch by moving the die further downwards until the die reaches a lower movement dead point, wherein during the forming of the second region a peripheral region of the metal sheet is clamped between the die ring and the downholder and between the die ring and the punch so as to prevent flow of metal sheet material from the border region of the metal sheet so that only the local material reserves are used for the forming of the second region, wherein the punch inserts are actively retracted by a mechanical coupling configured as catches with the downholder, wherein the punch inserts are fastened on a frame moved along by the catches arranged on the downholder.

2. The method of claim 1, wherein a drawing depth of the sheet metal part is at least 200 mm.

3. The method of claim 2, wherein the drawing depth is at least 250 mm.

4. The method of claim 2, wherein the drawing depth is at least 300 mm.

5. The method of claim 1, wherein the punch inserts are retracted asynchronously.

6. The method of claim 1, further comprising generating with at least one of the punch inserts an edge in the sheet metal part free of skid and impact lines, said edge having a radius.

7. A pressing tool for producing a complex sheet metal part, said pressing tool comprising:

a first tool part including a punch, a displaceable downholder surrounding the punch, and multiple movable punch inserts, said downholder including catches configured to couple the downholder to the at least one punch insert, so that a downward displacement of the downholder causes active retraction of the at least one punch insert; and a second tool part including a die and a die ring surrounding the die, wherein at least one of the punch inserts is resiliently supported on a frame; and said frame is configured to be moved along by the catches of the downholder.

8. The pressing tool of claim 7, wherein at least one of the punch inserts is configured for forming an edge in a metal sheet free of skid and impact lines, said edge having a radius.

9. The pressing tool of claim 7, wherein the die has at least one movable die insert which is situated opposite a respective one of the punch inserts.

10. The pressing tool of claim 9, wherein the movable die insert is configured for forming an edge in a metal sheet free of skid and impact lines.

* * * * *